United States Patent [19]

Joans

[11] 3,941,158

[45] Mar. 2, 1976

[54] WEFT MIXER DEVICES FOR LOOMS

[75] Inventor: André Joans, Mulhouse, France

[73] Assignee: Societe Alsacienne de Constructions Mecaniques de Mulhouse, Mulhouse Cedex, France

[22] Filed: Dec. 10, 1974

[21] Appl. No.: 531,338

[30] Foreign Application Priority Data

Dec. 17, 1973 France ..... 73.45005

[52] U.S. Cl. ..... 139/122 W

[51] Int. Cl.[2] ..... D03D 47/00; D03D 47/38

[58] Field of Search ..... 139/122 W, 122 R, 122 H, 139/123–127 R; 66/125, 132

[56] References Cited

UNITED STATES PATENTS

| | | | |
|---|---|---|---|
| 936,324 | 10/1909 | Jorrand | 139/122 W |
| 1,102,110 | 6/1914 | Wahl | 139/122 W |
| 3,439,715 | 4/1969 | Juillard | 139/122 W |

FOREIGN PATENTS OR APPLICATIONS

| | | | |
|---|---|---|---|
| 243,506 | 9/1969 | U.S.S.R. | 139/122 W |

OTHER PUBLICATIONS

American Iwer, Introduces the Revolutionary Twin Rapier Shuttleless Weaving Machine.

*Primary Examiner*—James Kee Chi
*Attorney, Agent, or Firm*—Holman & Stern

[57] ABSTRACT

This invention relates to a weft mixer device for looms which comprises a plurality of selection fingers each one of which can occupy either an active position in which it supports a weft yarn in the path of a weft-inserting member or an inactive position in which it supports a yarn outside of said path. The selection fingers are mounted for oscillation on a common vertical shaft supported by the loom frame and are articulated on said shaft about an axis at right angles to the axis of said shaft. The selection fingers are guided between the bars of a grid which consists of a frame having two opposed sides of unequal length and in which are mounted movable bars which extend between said two opposed sides. The internal length of the shorter of said two opposed sides is substantially equal to the sum of the thicknesses of said bars and of the thickness of a single selector finger, and the internal length of the longer of said sides is at least equal to the sum of the thicknesses of all of said bars and all of said selection fingers.

4 Claims, 6 Drawing Figures

WEFT MIXER DEVICES FOR LOOMS

This invention relates to weft mixer devices for looms of the type described, for example in Applicants' French Pat. No. 1,489,089, corresponding U.S. Pat. No. 3,439,715, i.e. comprising a plurality of selection fingers each of which can occupy either an active position in which it supports a weft yarn on the path of a weft-inserting element such as a needle or a picker, or an inactive position in which it supports the yarn outside of said path.

In the embodiment described in the aforesaid French patent, all the selection fingers are mounted with the capability of oscillation on a common vertical axis supported by the loom frame, such that the levelling-out of the make-up point of the different selected weft yarns varies in terms of the height of the finger which supports the respective yarn. If this construction is not cumbersome in a single-cloth loom, it is quite another matter in a multi-cloth loom, especially looms for manufacturing velvet, in which the two cloths are relatively quite close to one another.

In one known preferred embodiment of the weft selector of the kind in question, the fingers are guided between the bars of a grid, so that on drawing very close to said bars and on being caused to pass beyond the overhanging fingers, outside of the grid, by a sufficient length, it seems that there could be imparted to the fingers articulated on the vertical shaft which supports them, movements of such configuration that in the active position their ends are substantially in the same point in space. However, such a hypothesis is purely theoretical; indeed, given that the whole mechanism has to travel at high speed, the fingers must be rigid, their length and their fineness are thus limited, so that it is found that the bars of the guide grid would have to be brought nearer to said fingers to an extent such that there would no longer remain any material to make up said bars.

The object of the invention is to provide a grid for guiding the selection fingers and which permits this problem to be resolved.

According to the present invention, we provide a weft mixer device for looms, comprising a plurality of selection fingers each one of which can occupy either an active position in which it supports a weft yarn in the path of a weft inserting member or an inactive position in which it supports a yarn outside of said path, said selection fingers being mounted for oscillation on a common vertical shaft supported by the loom frame and being articulated on this vertical shaft about an axis at right angles to the axis of said shaft, and a grid between the bars of which said selection fingers are guided, said grid being formed by a frame of which two opposed sides are of unequal length and in which are mounted movable bars which extend between said two opposed sides, the internal length of the shorter of said sides of the grid frame being substantially equal to the sum of the thicknesses of said bars and of the thickness of a single selection finger, while the internal length of the longer of said sides of the grid frame is at least equal to the sum of the thicknesses of all the bars and of all the selection fingers.

Thanks to this particular construction, all the bars of the grid and the single selection finger in the active position, no matter which finger is in service, are in mutual contact in practice in the part of the grid which determines the location of the end of the finger which supports the selected weft yarn, so that the height of the grid at this position is reduced strictly to the minimum, which enables location of same in a size compatible with its mounting in a loom for velvet. This construction, moreover, has enabled giving to the selection fingers as well as to the guide bars large thicknesses suitable for making the rigid members functionally sure and precise.

For a loom for several cloths, the grid is obviously multiple and composed of as many superposed assemblies, such as have just been described, as the loom includes cloth lengths to be manufactured. However, a grid conceived on this principle can also be used in a single-cloth loom and provides the advantage of enabling the attainment of a weft selection device less cumbersome than in the classic constructions.

In one preferred embodiment the bars are articulated on the larger of the aforesaid sides of the frame of the grid and this leads to the attainment of a structure which is both simple and robust.

The invention will be better understood on reading the following description, and on examining the accompanying drawings, which show, by way of non-limiting example, one embodiment of a double grid according to the invention for guiding selection fingers of a mixer of weft yarns in a two-cloth loom.

Figure 1:
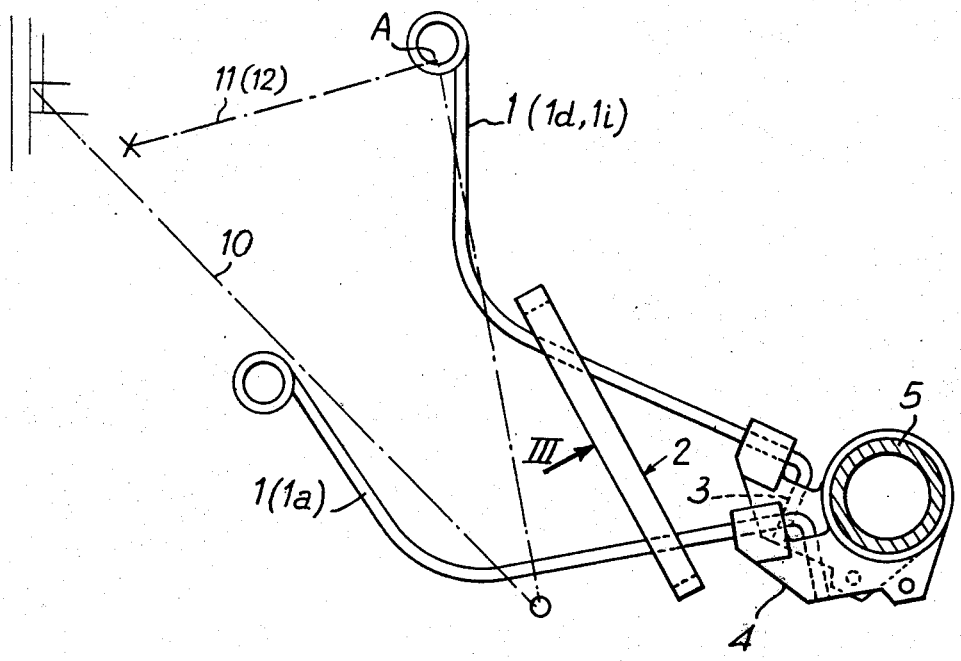
FIG. 1 is a plan view showing both the weft-selection fingers and the grid for guidance of said fingers.

Referring now to the drawings, the part of the weft mixer shown in FIG. 1 comprises two series of selection fingers designated in a general manner by the reference numeral 1, engaged between the bars of a guide grid 2, and each mounted for pivotal movement, by its bent proximal end 3, on a support 4 itself mounted for pivotal movement on a vertical shaft 5. The pivot axis 3 of each finger on its support 4 is at right angles to the axis of the support shaft 5. All of the supports 4 are stacked upon one another on the shaft 5 and they can be made to oscillate about said shaft, from the inactive position shown in the lower part of FIG. 1 to the active position shown in the upper part of FIG. 1, by means of any suitable control system, for example a system similar to that described in the aforesaid French patent.

This weft mixer device is intended to fit out a loom for the manufacture of velvet and it comprises, for each of the two lengths of cloth to be formed, a group of six selection fingers, that is to say, the fingers 1*a* to 1*f* (FIG. 3) for the upper length of cloth and 1*g* to 1*l* for the lower length of cloth.

Figure 2:
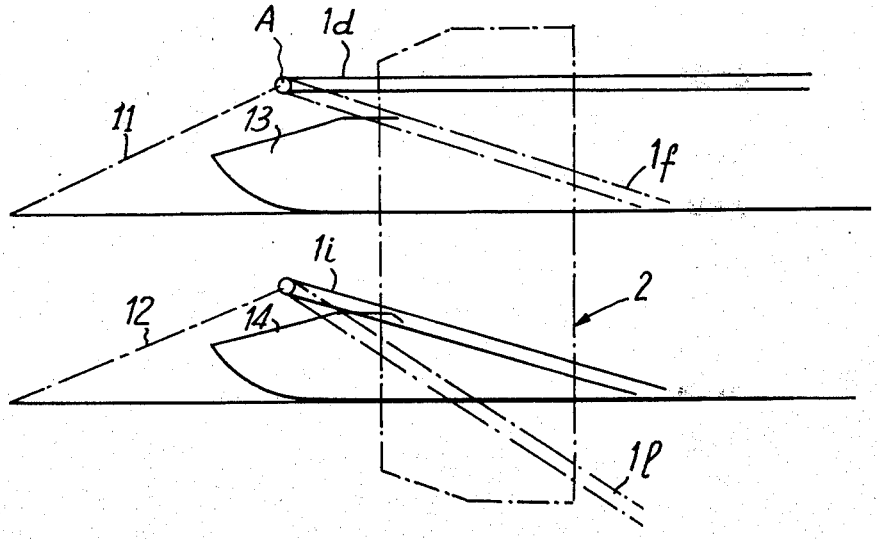
FIG. 2 is an elevation corresponding to part of FIG. 1.

In the embodiment shown, it is supposed that the selection fingers temporarily taken into the active position in the upper length of cloth and in the lower length of cloth are, respectively, the fingers 1*d* and 1*i* which alone have been shown on FIG. 2. The two fingers 1*d* and 1*i* in the active position support respectively two weft yarns 11 and 12 on the path of two weft inserters 13 and 14 respectively; on the other hand, all the other fingers, such as 1*a*, for example, which are in the inactive position, support the weft yarns such as 10 outside of the path of the weft inserters 13 and 14.

The grid is made up of an upper frame 2A and a lower frame 2B formed from a single member fixed on the frame by an angle-bar 7. Each of the two frames, for example the upper frame 2A, includes two opposed vertical sides of unequal lengths, namely: a larger side 21 and a smaller side 22, as well as an upper side 23 and a lower side 24, the latter being moreover integral with the upper side 23B of the lower frame 2B, the lower side of which is denoted 24B. Between the upper side and the lower side of each of the two frames, for example of the upper frame 2A, are mounted five movable bars 26*a* to 26*e* for separating and guiding the six selection fingers 1*a* to 1*f*.

The first finger 1*a* is guided between the first bar 26*a* and the upper side 23 of the frame 2A, and, in a similar manner, the last finger 1f is guided between the last bar 26*e* and the lower side 24 of said frame, while the other intermediate fingers 1*b* to 1*e* are each guided between two successive bars.

Figure 6:
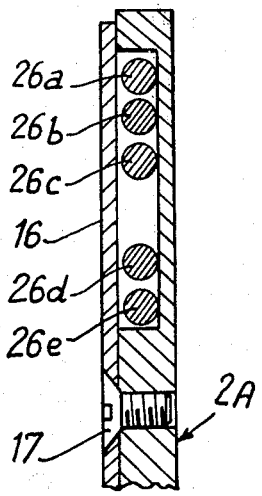
FIG. 6 is a section along the line VI—VI of FIG. 3.
Figure 4:
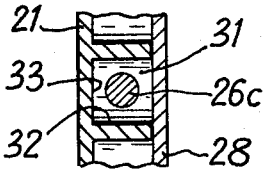
FIGS. 4 and 5, are partial sections, on a larger scale, along the lines IV—IV and V—V of FIG. 3.
Figure 5:
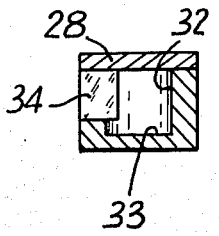

One end of each of the movable bars in articulated on the larger vertical side 21 of the frame 2A in such a manner as to enable same to pivot in the plane of the grid. To this end, each end of each movable bar, for example of the bar 26*c*, is unitary with a cylindrical boss 31 (see also FIG. 4) which can turn in a corresponding cylindrical housing 32 (FIG. 5) provided with a holding-in cover 33 contrived in the larger side 21 of the frame. The cylindrical housing 32 opens into the interior of the grid through a clearance 34 (FIGS. 3 and 5) to enable removal of the corresponding bar 26*c* for example. One cover plate 28 fixed, by screws 29, against the face of the vertical side 21 of the frame prevents the boss 31 from leaving its housing 32. The free ends of the pivoting bars are retained, also, by a small plate 16 fixed against the smaller side 22 of the frame by screws 17 (see also FIG. 6).

The height or internal length "C" of the larger vertical side 21 of the frame is amply sufficient in order that the six selection fingers 1*a* to 1*f* and the five intermediate bars 26*a* to 26*e* may occupy their position between the two upper and lower sides 23 and 24 of the frame.

Figure 3:
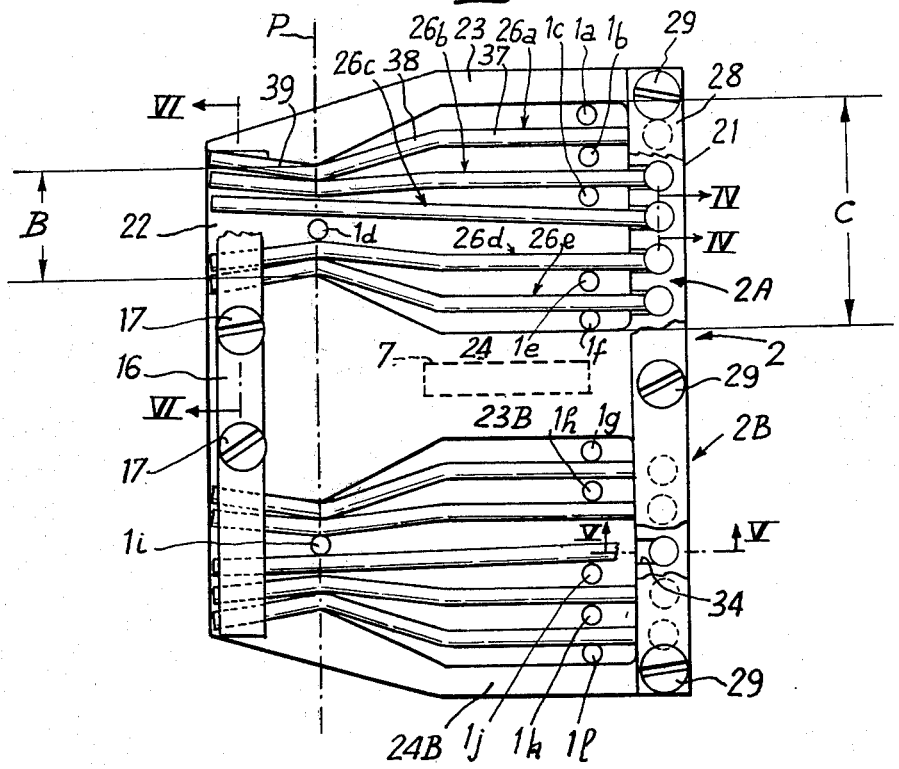
FIG. 3 is a front view of the grid seen in the direction of the arrow III in FIG. 1.

On the other hand, in a plane denoted P on FIG. 3, perpendicular to the plane of the grid and corresponding with the location of the fingers, such as for example the finger 1*d*, in the active position, the space between the upper side 23 and the lower side 24 of the frame 2A, that is to say the internal length "B" of the smaller vertical side 21, is only equal to the sum of the thicknesses of all the bars 26*a* to 26*e* increased by the thickness of a single selection finger, this being the finger 1*d* in the embodiment shown. In another example of selection, the finger 1*d* would be in the inactive position, close to the larger vertical side 21 of the frame, and another finger, for example the finger 1*b* would be in the plane P. In other words, in this plane P, there are always to be found the five guide bars and, when the machine is in operation, one selection finger, but only one.

In the embodiment shown, each movable bar, for example the bar 26*a* presents, considered from its pivot axis, a straight part 37 substantially parallel to the upper and lower sides 23 and 24 of the frame, followed by a straight part 38 which extends closer to the other bars until it reaches the plane P, and finally a third straight part 39 which opens slightly away from the other bars. The bar 26*c* which is midway of the height of the grid is straight over the whole of its length. The configurations of the upper and lower sides 23 and 24 of the frame correspond to the configuration of the first bar 26*a* and the last bar 26*e*, respectively, while leaving between them and the corresponding bar the passage of the first and of the last selection finger, respectively.

The construction of the lower grid in the frame 2B is the same as that of the upper grid in the frame 2A.

The positions and the dimensions of the different members of the assembly shown are such that the ends of each of the selection fingers for example 1*a* to 1*f* of the upper group are substantially at the same point A in space (FIGS. 1 and 2) when they are selectively in the active position. The fact that the movable bars have been made to be movable vertically has enabled considerable reduction in the height of the grid in the plane P and, consequently, the attainment of this uniformity of location of the yarn guiding ends of the selection fingers, even though said fingers are relatively short and, consequently, rigid, which ensures precision in the location of the yarn make up such as 11 or 12. Moreover, the whole of the device is reduced in height to the minimum necessary to enable same to be located in the zone of reduced height which is available on a loom for velvet.

For a loom with a large number of lengths of cloths, there would be provided multiple grids including the corresponding number of stages and, on the other hand, use could be made of a grid made on this principle for a single-cloth loom.

Of course, the invention is not limited to the embodiments described and shown; modifications could be carried out, in accordance with the applications in prospect, without thereby departing from the scope of the invention.

Thus, for example, the mobility of the bars of the grid could be brought about by means other than those described and shown.

I claim:

1. Weft mixer device for looms which includes a frame and at least one weft-inserting member, said device comprising a. a plurality of selection fingers each adapted selectively to occupy an active position in which it supports a weft yarn in the path of a weft inserting member and in inactive position in which it supports a weft yarn outside of said path;

b. a vertical shaft supported by the loom frame;

c. means mounting said selection fingers on said shaft for swinging movement about the axis of said shaft, said selection fingers being articulated about an axis at right angles to the axis of said shaft; and d. a grid including a frame having two opposed sides of unequal lengths and bars movably mounted in said grid frame and extending between said opposed sides, adjacent ones of said bars defining therebetween spaces in which said selection fingers can be guided;

the internal length of the shorter of said opposed sides of said grid frame being substantially equal to the sum of the thicknesses of said bars and of the thickness of a single said selection finger, and the internal length of the longer of said opposed sides of said grid frame being at least equal to the sum of the thicknesses of all the bars and of all the selection fingers.

2. Device according to claim 1, in which said bars are articulated on said longer of said opposed sides of said grid frame.

3. Device according to claim 2, in which bars extend from their points of articulation initially substantially parallel to one another then convergently relative to one another and finally divergently relative to one another.

4. Device according to claim 3 for a loom for a plurality of cloths, in which said grid is multiple and includes as many assemblies consituted by a frame and movable bars as there are cloths to be made up in said loom.

* * * * *